United States Patent [19]

Lloyd

[11] Patent Number: 4,634,033

[45] Date of Patent: Jan. 6, 1987

[54] PAPER TOWEL DISPENSER

[76] Inventor: Benjamin L. Lloyd, Rte. 2, Box 122, Kennedy, Ala. 35574

[21] Appl. No.: 632,655

[22] Filed: Jul. 20, 1984

[51] Int. Cl.[4] ..... B26F 3/02; A47K 10/36

[52] U.S. Cl. ..... 225/73; 225/51; 225/82

[58] Field of Search ..... 225/73, 74, 79, 80, 225/87, 67, 82, 59, 51.52

[56] References Cited

U.S. PATENT DOCUMENTS

| | | | |
|---|---|---|---|
| 398,750 | 2/1889 | Ross | 225/82 |
| 424,788 | 4/1890 | Hubbell | 225/73 |
| 648,837 | 5/1900 | Blue | 225/74 |
| 1,208,957 | 12/1916 | Handy | 225/80 |
| 1,606,774 | 11/1926 | Nelson | 225/67 |
| 1,952,374 | 3/1934 | Hill | 225/74 |
| 2,818,221 | 12/1957 | Thieman | 225/73 |
| 2,834,646 | 5/1958 | Berg | 225/73 |
| 3,190,520 | 6/1965 | Wyant | 225/73 |

*Primary Examiner*—Frank T. Yost
*Assistant Examiner*—Hien H. Phan
*Attorney, Agent, or Firm*—Berman, Aisenberg & Platt

[57] ABSTRACT

A dispenser for a roll of flexible material has been described. A housing supports the roll for rotation about an axis, and a braking and severing device is mounted to the housing. The braking and severing device provides a lever and a contacting element. The lever includes a cutting edge so that as the flexible material is pulled against the cutting edge, the lever causes rotation of the contacting element against the roll to thereby prevent further rotation of the roll. In the preferred embodiment, the braking and severing device comprises two thin, flat elements secured together with a spacer to provide a gap for passage of the flexible material.

2 Claims, 3 Drawing Figures

FIG 1
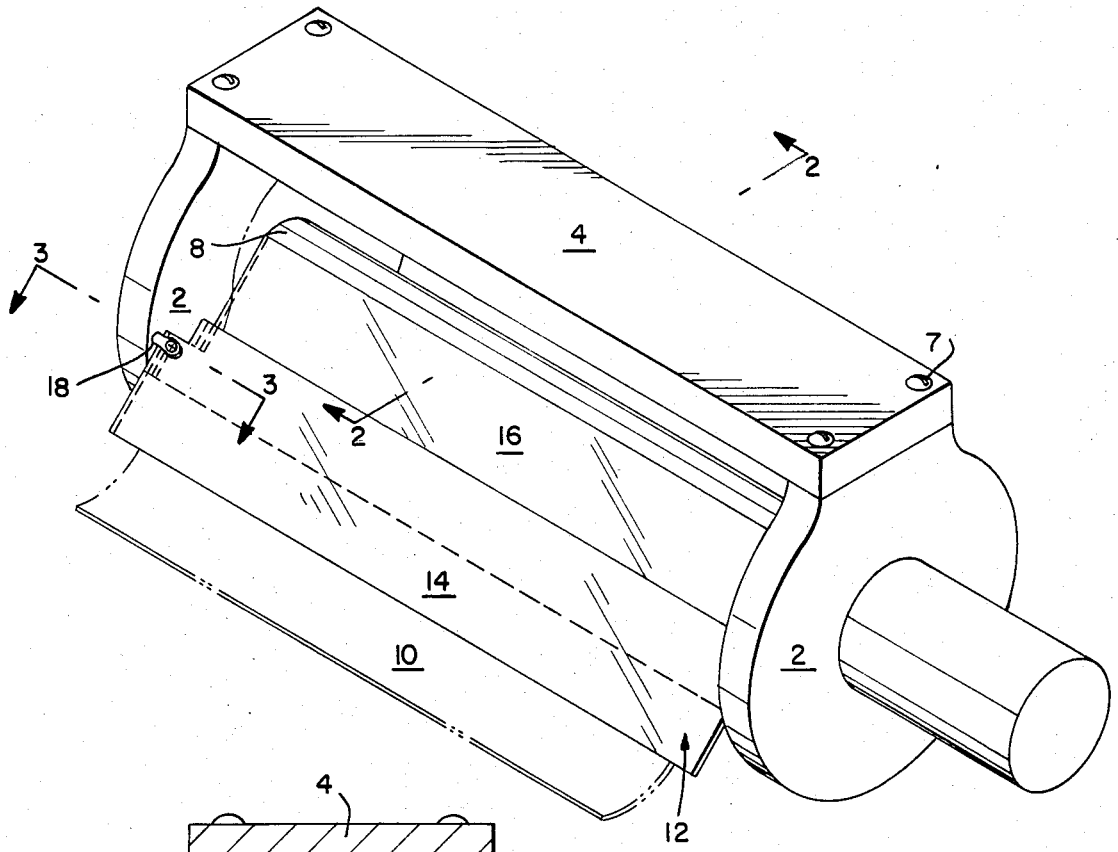
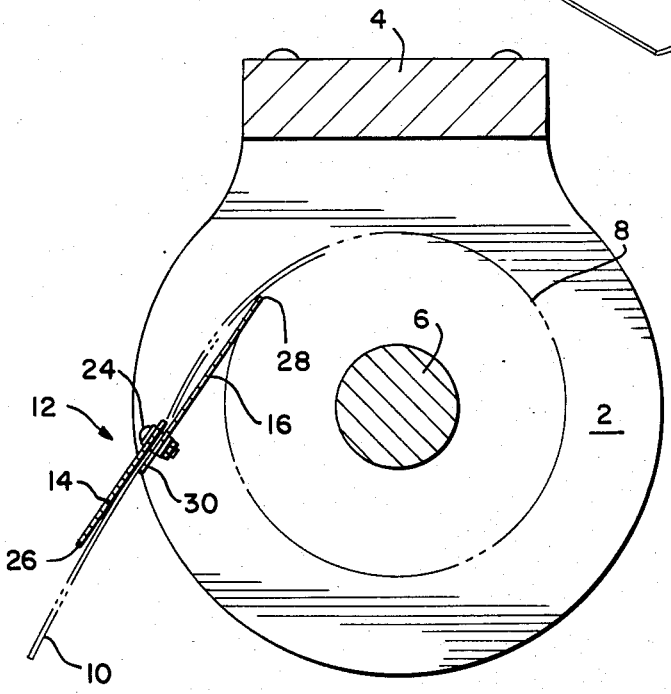
FIG 2
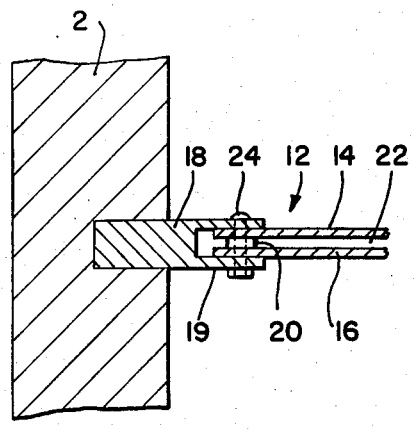
FIG 3

PAPER TOWEL DISPENSER

FIELD OF THE INVENTION

This invention relates to the art of dispensers for rolled sheet material.

BACKGROUND ART

A known support for a roll of flexible material, such as paper towels, comprises a housing having cylindrical protrusions for engaging a hollow core around which the paper towels are rolled. This structure allows the roll to freely rotate but provides no mechanism for facilitating tearing a piece of the flexible material from the roll.

Other apparatus are known whereby a cutting edge is provided for facilitating the removal of a section of the flexible material by tearing it from the roll.

U.S. Pat. No. 224,010 (Gilson) shows a device wherein a roll of paper is mounted for rotation about an axis. A housing includes a knife edge which may be contacted by a loose end of the paper roll to facilitate tearing a section from the roll.

U.S. Pat. No. 354,981 (Jerome) shows a device for tearing wrapping paper. A housing supports a roll of paper for rotation about an axis and also provides an elongate slot through which a loose end of the roll of paper passes. One edge of the slot is slightly sharpened, and a sheet of paper passing through the slot may be severed from the roll by pulling the loose end against the sharpened edge.

U.S. Pat. No. 2,205,645 (Currier) shows a paper dispenser having a housing which supports a roll for rotation about an axis. A cutting bar is pivotally mounted to the housing and rotates about an axis parallel to the axis of rotation of the roll. The cutting bar is spring-biased to engage an outer surface of the roll and provides a relatively rough edge for engagement with the paper whereby a section of paper may be severed from the roll.

U.S. Pat. No. 3,105,622 (Waltz) shows a dispenser for rolled sheet material. A housing supports the roll for rotation, and a cutting bar is held adjacent an outer surface of the roll by resiliently flexible elements.

SUMMARY OF THE INVENTION

None of the above-described prior art provides an effective mechanism for preventing rotation of the roll of sheet material when a piece of the material is being torn from the remainder of the roll. This presents a problem if the sheet material does not engage the cutting edge properly because the material will continuing unrolling rather than being severed.

In accordance with the invention, a mechanism is provided whereby a brake automatically engages the roll of flexible material when the loose end of the material is pulled against a cutting edge. This mechanism prevents unwanted unrolling of the roll of material and allows a section of flexible material to be easily torn from the remainder of the roll.

An apparatus in accordance with the invention includes a housing for supporting a roll of flexible material for rotation about an axis and a braking means which is mounted for rotation about an axis which, in the preferred embodiment, is parallel to the axis of rotation of the roll of flexible material. The braking means includes a first element which acts as a lever to cause the braking means to rotate when the flexible material is being torn. A second element of the braking means is a contacting element which rotates to engage the roll of flexible material when the end of the material engages the lever means.

In the preferred embodiment, the lever and the contacting element are generally thin, flat members secured to each other and spaced to provide a gap. The flexible material passes through the gap so that it goes over one element and under the other. By this arrangement, when the flexible material is pulled against a cutting edge of the lever element, the contacting element automatically rotates into such a position that it engages the roll of flexible material and acts as a brake to prevent unwanted rotation.

The braking member could take other forms. For example, a single flat element with an elongate transverse slot to receive the flexible material is an alternative form.

An object of this invention is to provide a dispenser for a roll of flexible material which provides an effective means for severing a piece of the material from the remainder of the roll.

A further object of this invention is to provide a dispenser for a roll of flexible material wherein the dispenser provides a brake for preventing rotation of the roll during removal of a portion of the flexible material.

A still further object of this invention is to provide a housing for a roll of paper towels wherein a unique tearing edge includes an element for engaging an outer surface of the roll to prevent its rotation during removal of a single towel.

BRIEF DESCRIPTION OF THE DRAWINGS

FIG. 1 is a perspective view of a dispenser in accordance with the invention.

FIG. 2 is an enlarged cross section taken along line 2—2 of FIG. 1.

FIG. 3 is an enlarged cross section taken along line 3—3 of FIG. 1.

DETAILED DESCRIPTION

FIG. 1 is a perspective of a preferred embodiment of the apparatus in accordance with the invention. A housing includes side elements 2 secured to top element 4 by suitable fasteners, such as screws 7. An axle 6 (see FIG. 2) extends between side elements 2 to support a roll 8 of paper towels or other flexible material 10.

A braking and severing device 12 is pivotally mounted between side elements 2. The braking and severing device includes a lever 14 and a contacting element 16 which are elongated flat plates. Lever 14 extends outwardly from the role 8 and contacting element 16 has a major portion extending inwardly toward the roll 8. The lever and the contacting element are preferably secured together for rotation about an axis parallel to the axis of rotation of roll 8 about axle 6. In the preferred embodiment, two similar pins 18, only one of which is seen in FIG. 1, mount the breaking and severing device 12 to side elements 2 for rotation.

FIGS. 2 and 3 show the preferred construction of the braking and severing device 12 in more detail. With reference to FIG. 3, lever 14 is separated from contacting element 16 by a spacer 20 to form a gap 22. A fastener 24 secures a clevis-type end 19 of pin 18 to lever 14 and contacting element 16 and holds spacer 20 in place. Pins 18 are mounted in complemental holes in elements 2 for rotation. The pin 18, fastener 24 and spacer 20 form a means having the combined function of connecting the plates 14 and 16 in spaced overlapping relationship and also mounting them for rotation on the housing.

With reference to FIG. 2, material 10 extends from roll 8 over contacting element 16, through gap 22 and under lever 14. Lever 14 includes a cutting edge 26 which engages material 10 to assist in severing a section of the material from the remainder of the roll 8. When material 10 is pulled against cutting edge 26, the braking and severing device 12 automatically rotates about an axis formed by pins 18 and causes end 28 of contacting element 16 to engage roll 8 to prevent further rotation of the roll.

Contact element 16 also includes a releasing edge 30 which extends forwardly from the axis of rotation of the braking and severing device 12. In the event that it is necessary to rotate the braking and severing device 12 to release pressure by end 28 on roll 8, the flexible material may be pulled downwardly against end 30. In the preferred embodiment, lever 14 and contacting element 16 are of relatively thin, flat transparent plastic material to provide cutting edge 26 and to allow one to view the roll 8 through the braking and severing device.

It will be appreciated that while FIG. 2 shows material 8 passing over contacting element 16 and under lever elements 14, it is possible to invert roll 8 and braking and severing device 12 so that contacting element 16 is located below the center of roll 8. In such position, the material 10 will pass under contacting element 16 and over lever 12. In this case, the force required to sever a piece of material would be directed downwardly.

It will be appreciated that an efficient and inexpensive dispenser for a roll of flexible material has been described. Modifications in accordance with the appended claims will be apparent to those of skill in the art.

What is claimed is:

1. Paper towel dispenser comprising a roll of paper towels mounted on a housing for rotation about a first axis, and a combined braking and severing device mounted on said housing for rotation about a fixed second axis, said device comprising a pair of flat elongated plates extending longitudinally along the outer surface of said roll, said plates being superimposed and spaced from each other to receive a loose end of said roll of towels therebetween, means for connecting the superimposed portions of said plates and for mounting said plates on said housing for rotation about said second axis, one of said plates extending outwardly from said roll, the other of said plates having a major portion extending inwardly toward said roll and a minor portion extending outwardly from said roll, whereby when a force is applied to the loose end in order to remove a portion thereof said one of said plates acts as a lever to rotate said device to bring said other of said plates into braking contact with the outer surface of said roll and permit the loose end to be severed with the aid of said one plate.

2. Apparatus comprising housing means for supporting a roll of paper for rotation about a first axis, braking and severing means comprising a pair of elongate plates extending parallel to said first axis and mounted for rotation about a fixed second axis parallel to said first axis, said pair of plates being superimposed and spaced from each other to receive a loose end of said roll of paper therebetween, one of said plates extending outwardly from said second axis and the other of said plates extending toward said first axis, whereby when a loose end of a roll of paper extends between said plates, a portion of said roll may be removed by pulling said portion against said one of said plates causing said other of said plates to engage said roll to act as a brake.

* * * * *